United States Patent [19]

Staufer

[11] 4,377,297

[45] Mar. 22, 1983

[54] SKI, PARTICULARLY ALPINE SKI

[75] Inventor: Adolf Staufer, Molln, Austria

[73] Assignee: Fisher Gesellschaft m.b.H., Innkreis, Austria

[21] Appl. No.: 210,669

[22] Filed: Nov. 26, 1980

[30] Foreign Application Priority Data

Nov. 29, 1979 [AT] Austria ..... 7566/79

[51] Int. Cl.[3] ..... A63C 5/04

[52] U.S. Cl. ..... 280/609

[58] Field of Search ..... 280/609, 608, 607, 604, 280/601, 610; 9/310 A, 310 R

[56] References Cited

U.S. PATENT DOCUMENTS 2,510,794 6/1950 Beerli ..... 280/609

3,015,831 1/1962 Franke ..... 9/310 A

FOREIGN PATENT DOCUMENTS 173373 5/1947 Austria ..... 280/609

643186 3/1937 Fed. Rep. of Germany ..... 280/609

48590 10/1930 Norway ..... 280/609

*Primary Examiner*—David M. Mitchell

*Attorney, Agent, or Firm*—Fleit & Jacobson

[57] ABSTRACT

A ski, particularly an Alpine ski, wherein the steering of the ski while edging, particularly its ability to execute carved turns, and its edge grip, are improved in that the lateral boundary lines of its bottom edges are so designed that the width of the ski has a relative maximum adjacent to the midpoint of the ski and a relative minimum in the forebody and in the afterbody of the ski. To facilitate the use of the design according to the invention in skis differing in length, it is proposed to superpose a concave base curve and a convex curve portion at the center of the ski. In order to facilitate the use of numerically controlled machines for manufacture, a complete mathematical expression for an embodiment of the invention is stated.

7 Claims, 2 Drawing Figures

SKI, PARTICULARLY ALPINE SKI

SUMMARY OF INVENTION

Figure 1:
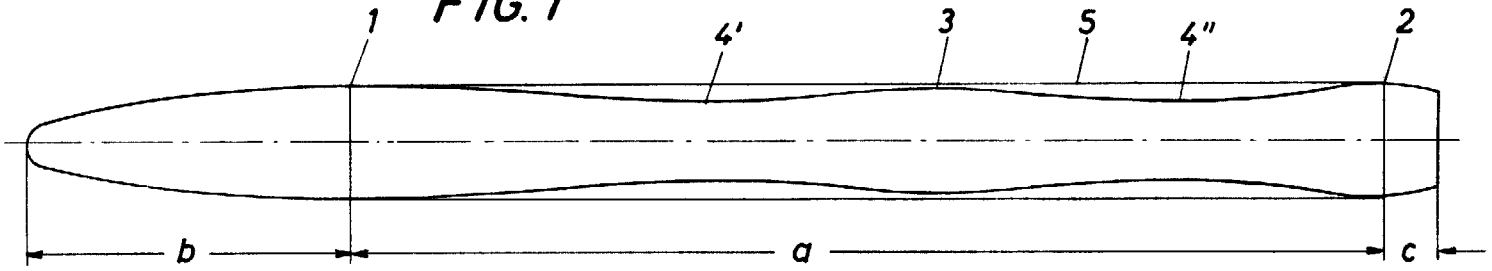

A ski, particularly an Alpine ski, which at the center of its length has a width that is smaller than or as large as the mean value of the largest width in the forebody and the largest width in the rear ski body. The width of the ski has a relative maximum adajcent to the length center midpoint of the ski and a relative minimum in the forebody and in the afterbody of the ski.

DESCRIPTION OF THE PRIOR ART

Most skis of the kind concerned are laterally bounded at their bottom edges by slender, concave curves and have in most cases a largest width in the forebody at the junction of the forward turn up, a relative minimum adjacent to the midpoint of the ski and a relative maximum near the tail turn up. That width distribution is sometimes described as Telemark configuration and has mainly been adopted because the ski while edging should be able to necessarily carve a turn on a certain radius. Whereas the carved turn is always combined with a superposed slide slip, the change of the side curvature of the ski may influence its ability to execute carved turns. The lateral boundary curve of the ski from the point of largest width in the forebody of the ski to the point of largest width in the afterbody of the ski is described as the side cut of the ski.

It is known, for instance, to provide a side cut in the form of an arc of a circle over a chord which has such an inclination relative to the longitudinal axis of the ski that the width in the afterbody of the ski is smaller than in the forebody of the ski. The smaller the radius for a given chord length, the more strongly is the ski narrowed and the higher is its ability to execute carved turns on a small radius. On the other hand, a more strongly narrowed ski has the disadvantage that its edge grip, i.e., its ability to transmit lateral steering forces for compensating for centrifugal forces, is reduced. This is due to the fact that owing to the torsional stiffness of the ski a more pronounced narrowing has the result that the forces acting at the mass centroid are more pronouncedly distributed over the length of the ski than in a less narrowed ski. As a result, the edge pressure at the midpoint of the ski is reduced so that said pressure is no longer sufficient to cause the steel edge or bottom edge to carve into the hard trail. For this reason, skis which are only slightly narrowed are preferred for hard slopes so that a high pressure concentration for carving the trail is obtained at the midpoint of the ski. A disadvantage of these skis resides in that the tangents to the side cut adjacent to the forward and tail turn ups are only very slightly inclined to the direction of the axis of the ski and for this reason are not highly capable of carving turns. Particularly in soft or high-friction trails such skis have a pronounced tendency to run straight ahead and can be turned only with difficulty.

Whereas a very large majority of all skis particularly Alpine skis, have concave side cuts, it is also known to form the side cuts in accordance with different curves.

Austrian Patent Specification 173,373 essentially describes a ski in which the known concave side cut extends only over up to 85% of the contact length of the ski, i.e., of that length portion of the ski which contacts the trail, whereas the forwardly and rearwardly adjoining portions of the boundary curve have the same configuration and are symmetrically arranged. These adjoining curve portions are straight and aligned at least in part. Whereas that proposal improves the ease with which the ski can be turned, such design is highly unfavourable for a carving of turns because the directions of the tangents at the forward and the tail turn ups deviate little from the longitudinal direction of the ski.

German Patent Specification No. 643,186 proposes a ski having a convex side cut and the largest width at its midpoint. On a hard slope, the edge pressure exerted by such ski is almost entirely concentrated at the midpoint of the ski so that the edge grip is very strong there. On the other hand there is virtually no edge pressure at all adjacent to the forward and tail turn ups so that the directional stability of the ski is very poor. The inclination of the tangents adjacent to the forward and tail turn ups is such that turns cannot possibly be carved.

OBJECT OF THE INVENTION

It is an object of the present invention to provide a ski which is highly suitable for cutting turns having a small radius and which has a very strong edge grip on a smooth, hard slope so that the ski is more versatile and affords a higher safety.

This object is accomplished according to the invention in that the width of the ski has a relative maximum adjacent to the midpoint of the ski and a relative minimum in the forebody and the afterbody of the ski.

Another object of the invention is to permit a favorable incorporation of those properties of the ski which are responsible for the ability to carve turns and for a very good edge grip in skis differing in length.

A further object of the invention is to permit the use of numerically controlled production machines in the manufacture of the ski according to the invention.

In accordance with the invention this is accomplished in that the convex portion of the curve is a bell-shaped curve defined by the equation $$y = a\, e^{-K(x-x_0)^2}$$

It is also an object of the invention to provide the ski according to the invention in an embodiment which is particularly advantageous in view of present-day skiing techniques and of the teaching method presently used in skiing schools.

This is accomplished according to the invention in that the following inequality is applicable to the largest width $b_v$ in the forebody of the ski, the largest width $b_h$ in the afterbody of the ski, and the relative maximum width $b_{mm}$ adjacent to the midpoint of the ski:

$$b_v \text{ larger than } b_h \text{ larger than } b_{mm}$$

A further object of the invention is to provide the ski according to the invention in an embodiment which is particularly suitable for slalomlike skiing or for a skiing technique such as is used in slalom competitions.

This is accomplished according to the invention in that the height of the convex curve portion over the concave base curve at the maximum is 0.2 to 5 mm and preferably 1 to 3 mm.

DESCRIPTION OF THE DISCLOSURE

The invention will be explained with reference to FIGS. 1 and 2 of the drawing showing an illustrative embodiment, to which the invention is not restricted.

FIG. 1 is a top plan view showing a ski according to the invention. The width dimensions are exaggerated relative to the length. The forebody of the ski has the largest width at 1. The afterbody of the ski has the largest width at 2. Adjacent to its midpoint, the ski has a maximum width at 3. The width has a relative minimum at 4' in front of the maximum width at 3 and a relative minimum at 4" behind the maximum width at 3. The lengths of the side cut, of the forward turn up, and of the tapered tail turn up are designated a, b and c, respectively. The curve of the side cut is clear of the straight line 5 which connects points 1 and 2 so that in the embodiment shown by way of example the width maximum of the ski at 3 is less than the mean value of the largest width at 1 in the forebody and the largest width at 2 in the afterbody.

As a result of this design of the side cut according to the invention, there will be a concentration of pressure at the relative width maximum at 3 when the ski is edging so that a very strong edge grip will be obtained. Besides, the curve portions which adjoin points 1 and 2 are strongly inclined to the longitudinal axis of the ski and are strongly curved so that the ski is highly suitable for carving turns on a small radius. It will be particularly favorable if the maximum width at 3 is less than the mean value of the widths at 1 and 2 because a concave enveloping curve can then be laid through points 1, 2 and 3; this will further improve the ability of the ski to carve turns. It is apparent from the above that the ski according to the invention combines a very good edge grip and a very high ability to execute carved turns on a small raduis. The effect can be varied as desired in that the width relations are quantitatively changed.

To permit the incorporation of the side cut according to the invention in skis differeing in length, it is proposed to provide a side cut which has been obtained by the superposition of a concave base curve and a convex curve portion adjacent to the midpoint of the ski. With the aid of similarity transformations, such a curve can easily be transformed for use with skis differing in length. Besides, the superposition of a concave base curve and a convex portion at the midpoint of the ski offers numerous possibilities for variation by a change of the curvature of the concave curve and of the position and width of the convex curve portion.

Another object is to provide a ski according to the invention which can be manufactured by numerically controlled machine-tools.

A convex curve portion adjacent to the midpoint of the ski may preferably consist of a bell-shaped curve which is defined by the equation $$y = a\,e^{-k(x-x)^2}$$

wherein x is the independent coordinate in the longitudinal direction of the ski $x_o$ is the position of the maximum at 3 y is the dependent coordinate in the width direction a is the height of the bell-shaped curve at the maximum k is the parameter of shape which determines the width of the curve.

The use of curves which can be defined by a closed mathematical expression will be of special advantage in the use of numerically controlled machines in the manufacture of such skis.

Figure 2:
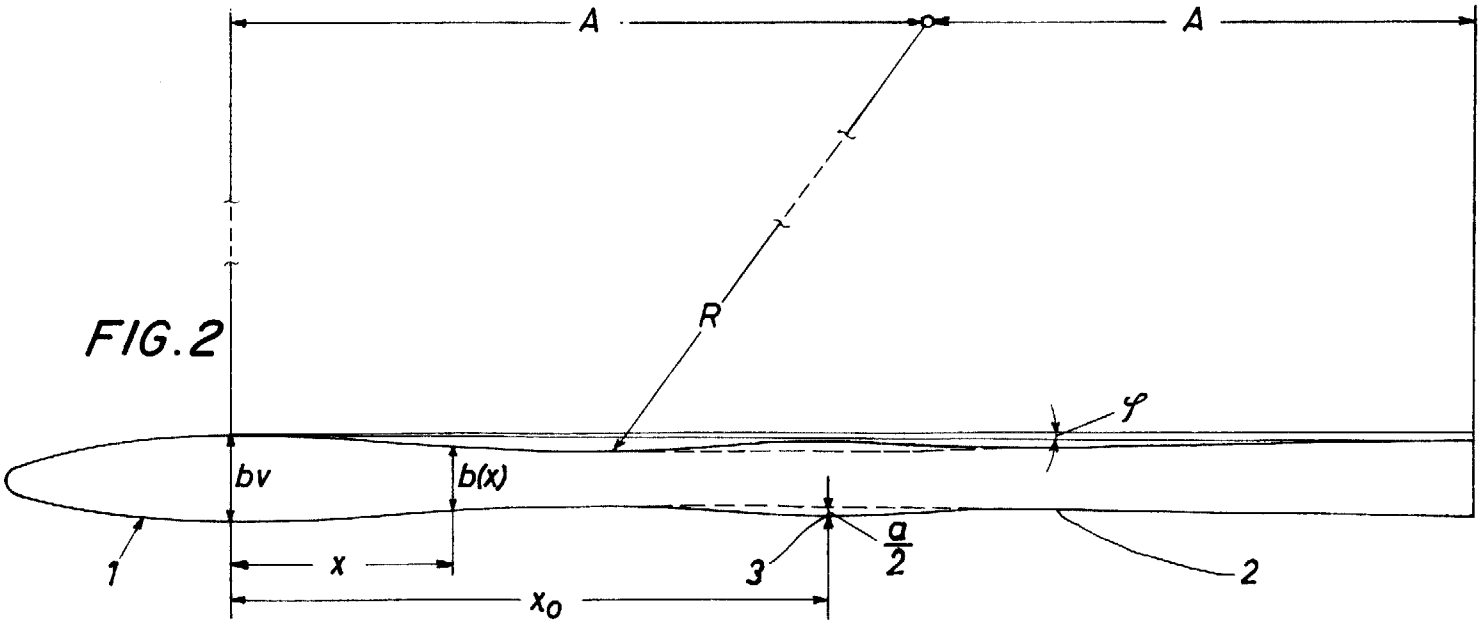

FIG. 2 shows a ski which is in accordance with the invention and in which, by way of example, the side cut has been obtained by the superposition of a concave base curve in the shape of an arc of a circle and a convex bell-shaped curve. The forward turn up, the concave curve portion having the shape of an arc of a circle, and the convex bell-shaped curve portion are designated 1, 2 and 3, respectively. Using the symbols indicated in FIG. 2, that curve or the ski width determined by it can be defined by the following expression:

$$b(x) = b_v - \frac{A^2 - (x - A)^2}{\sqrt{R^2 - A^2}} - 2 \times \tan\phi + a\,e^{-k}(x - x_o)^2$$

For this reason, this illustrative embodiment of the invention will be particularly well adapted for a manufacture with a numerically controlled machine-tool. By means of suitable similarity transformations, the curve can well be transformed for use with skis differing in length.

For the skiing technique which is predominantly praticed at present it will be desirable to provide a ski which is highly suitable for carving turns and has a good edge grip and can very easily initiate a turn. In the conventional ski this is usually accomplished, inter alia, in that the largest width in the forebody of the ski exceeds the largest width in the afterbody of the ski whereas the width has a relative minimum adjacent to the length center of the ski. It has been found that these width relations can be adopted in a ski according to the invention with the same favorable results.

These will be a very good match of the edge grip and the ability to execute carved turns if the height of the convex curve portion over the concave base curve is between 0.2 and 5 mm, preferably between 1 and 3 mm. This will mainly be desirable for slalomlike skiing because the time required to execute a turn will be minimized so that a particularly freely flowing skiing technique is permitted.

What is claimed is:

1. A ski for snow skiing having a forebody portion, an afterbody portion and an intermediate body portion, said ski comprising:

(a) concave side edges extending along said intermediate body portion to facilitate turning of said skis in snow; and (b) a convex portion superposed adjacent the midpoint of said concave side edges.

2. A ski in accordance with claim 1 wherein the width of said ski at said concave side edges is no greater than the maximum width of said ski measured at its forebody portion.

3. A ski in accordance with claim 1 wherein the maximum width of said ski at its forebody portion is greater than the maximum width of said ski at its afterbody portion, and the latter is greater than the maximum width at its intermediate body portion.

4. A ski in accordance with claim 3 wherein each of said concave side edges is defined by equal circular arcs and the width of said ski at said convex portions is from about 0.4 mm to about 10 mm greater than the minimum width defined by said circular arcs.

5. A ski in accordance with claim 4 wherein the width of said ski at said portions is from about 2 to about 6 mm greater than the minimum width defined by said circular arcs.

6. A ski in accordance with claim 1 wherein said convex side edges are in the form of a bell-shaped curve.

7. A ski in accordance with claim 6 wherein said convex side edges have a curvature defined by the following expression:

$$y = a\, e^{-k(x-x_0)^2}$$

wherein x is the independent coordinate in the longitudinal direction of the ski $x_0$ is the position of the maximum width y is the dependent coordinate in the width direction a is the height of the bell-shaped curve at the maximum k is the parameter of shape which determines the width of the curve.

* * * * *